US010537176B2

(12) United States Patent
Bock

(10) Patent No.: US 10,537,176 B2
(45) Date of Patent: Jan. 21, 2020

(54) ARMREST, IN PARTICULAR FOR AN OFFICE CHAIR

(71) Applicant: BOCK 1 GMBH & CO. KG, Postbauer-Heng (DE)

(72) Inventor: Hermann Bock, Pyrbaum (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 15/980,310

(22) Filed: May 15, 2018

(65) Prior Publication Data

US 2018/0325261 A1 Nov. 15, 2018

(30) Foreign Application Priority Data

May 15, 2017 (DE) ..... 10 2017 110 492

(51) Int. Cl.
*A47C 7/54* (2006.01)
*A47C 1/03* (2006.01)

(52) U.S. Cl.
CPC . *A47C 1/03* (2013.01); *A47C 7/54* (2013.01)

(58) Field of Classification Search
CPC ..... A47C 1/03; A47C 1/0303; A47C 1/0307; A47C 1/0308; A47C 7/54; A47C 7/541
USPC ..... 297/411.31, 411.35, 411.37
See application file for complete search history.

(56) References Cited

U.S. PATENT DOCUMENTS 5,380,065 A * 1/1995 Rohrer ..... A47C 1/03 297/411.35
5,393,124 A * 2/1995 Neil ..... A47C 1/03 297/411.35 X
5,407,249 A 4/1995 Bonutti
5,651,586 A * 7/1997 Groth ..... A47C 1/03 297/411.31
5,749,628 A * 5/1998 Synder ..... A47C 1/03 297/411.31
5,752,683 A * 5/1998 Novis ..... A47C 1/03 297/411.36 X
5,884,976 A * 3/1999 Breen ..... A47C 1/03 297/411.35
5,944,386 A * 8/1999 Yamagishi ..... A47C 1/03 297/411.31
5,975,640 A * 11/1999 Chen ..... A47C 1/03 297/411.31
6,053,577 A * 4/2000 Arko ..... A47C 1/03 297/411.31 X
6,074,012 A * 6/2000 Wu ..... A47C 1/03 297/411.26

(Continued)

FOREIGN PATENT DOCUMENTS

DE 19959104 A1 6/2001

*Primary Examiner* — Rodney B White

(74) *Attorney, Agent, or Firm* — Laurence A. Greenberg; Werner H. Stemer; Ralph E. Locher

(57) ABSTRACT

An armrest, in particular for an office chair, achieves improved handling and adjustability in an individual and in a particularly variable manner by providing a preferably height-adjustable armrest column, an arm support carrier which is mounted on the armrest column and which is rotatable about a first rotational axis, and an arm support which is mounted on the arm support carrier. The arm support is rotatable about a second rotational axis and is displaceable in a linear manner relative to the arm support carrier. The two rotational axes are spaced apart from one another.

18 Claims, 10 Drawing Sheets

(56) References Cited

U.S. PATENT DOCUMENTS 6,076,891 A * 6/2000 Bernhardt ..... A47C 1/03 297/411.31
6,106,070 A * 8/2000 Ritt ..... A47C 1/03 297/411.35
6,203,109 B1 3/2001 Bergsten et al.
6,213,556 B1 * 4/2001 Chen ..... A47C 1/03 297/411.35
6,290,300 B1 * 9/2001 Sutton ..... A47C 1/03 297/411.35
6,460,932 B1 * 10/2002 Kopish ..... A47C 1/03 297/411.35 X
6,588,847 B2 * 7/2003 Murakami ..... A47C 1/03 297/411.31
6,619,746 B2 * 9/2003 Roslund, Jr. ..... A47C 1/03 297/411.31
6,659,561 B1 * 12/2003 Lee ..... A47C 1/03 297/411.35
6,948,774 B2 * 9/2005 Maier ..... A47C 1/03 297/411.31
7,150,504 B1 * 12/2006 Lee ..... A47C 1/03 297/411.35
7,159,947 B1 * 1/2007 Lee ..... A47C 1/03 297/411.35
7,490,910 B1 * 2/2009 Draughon ..... A47C 1/03 297/411.31
7,556,316 B1 * 7/2009 Lai ..... A47C 1/03 297/411.35 X
7,559,609 B2 * 7/2009 Tsai ..... A47C 1/03 297/411.35
8,287,046 B1 * 10/2012 Wang ..... A47C 7/546 297/411.26
8,496,295 B2 * 7/2013 Chen ..... A47C 1/03 297/411.31
8,840,188 B2 * 9/2014 Diffrient ..... A47C 7/54 297/411.37
2002/0043862 A1 * 4/2002 Piretti ..... A47C 1/03 297/411.35
2006/0238011 A1 * 10/2006 Bedford ..... A47C 1/03 297/411.35
2011/0062763 A1 * 3/2011 Tsai ..... A47C 1/03 297/411.35
2011/0254340 A1 * 10/2011 Hsuan-Chin ..... A47C 1/03 297/411.31
2012/0025584 A1 * 2/2012 Chen ..... A47C 1/03 297/411.37
2012/0119557 A1 * 5/2012 Fang ..... A47C 1/03 297/411.35
2016/0316917 A1 11/2016 Qi et al.

* cited by examiner

ARMREST, IN PARTICULAR FOR AN OFFICE CHAIR

CROSS-REFERENCE TO RELATED APPLICATION

This application claims the priority, under 35 U.S.C. § 119, of German Patent Application DE 10 2017 110 492.5, filed May 15, 2017; the prior application is herewith incorporated by reference in its entirety.

BACKGROUND OF THE INVENTION

Field of the Invention

The invention relates to an armrest, in particular for an office chair.

Adjustable armrests are known from the prior art. Generally, those armrests have a rotary, longitudinal and/or transverse adjusting mechanism. However, armrests, in particular with many individual possibilities for adjustment, generally have a complex construction and have very many structural elements which cooperate with one another.

SUMMARY OF THE INVENTION

It is accordingly an object of the invention to provide an armrest, in particular for an office chair, which overcomes the hereinafore-mentioned disadvantages of the heretofore-known armrests of this general type, which provides improved handling of the armrest and which, in particular, is intended to be adjustable in an individual and in a particularly variable manner.

With the foregoing and other objects in view there is provided, in accordance with the invention, an armrest which comprises a preferably height-adjustable armrest column, an arm support carrier which is mounted on the armrest column and which is rotatable about a first rotational axis and an arm support which is mounted on the arm support carrier, which is rotatable about a second rotational axis and which is displaceable in a linear manner relative to the arm support carrier, wherein the two rotational axes are spaced apart from one another. A first basic concept of the invention, therefore, is to combine two rotational movements about rotational axes spaced apart from one another with a linear displacement. As a result, an armrest which is adjustable in an individual and in a particularly variable manner may be provided by employing especially simple measures.

In order to provide for a particularly variable adjustability in combination with a compact construction, embodiments of the invention have proved to be quite particularly advantageous in which the two rotational axes are not disposed coaxially relative to one another and/or in which the two rotational axes are located parallel to one another, i.e. not pivoted relative to one another and/or counter to one another, and/or in which the two rotational axes are disposed perpendicular, in particular in such a way that the rotations of the arm support carrier and the arm support take place in horizontally located planes, and/or in which the two rotational axes are spaced apart from one another horizontally, i.e. not only vertically but also horizontally offset from one another.

In order to be able to transfer the arm support into as many positions as possible, it is advantageous if the first rotational axis connects a first, in particular rear, region of the arm support carrier to the armrest column and the second rotational axis connects the arm support to a second, in particular front, region of the arm support carrier, which second region is spaced apart from the first region. The terms "rear/front" and/or "top/bottom" and/or "vertical/horizontal" etc. always refer in this case to the normal state of use of the office chair, in which the chair is located on a horizontal floor.

In order to provide for a particularly universal adjustability of the armrest, the arm support carrier and the arm support are preferably constructed in such a way that they are rotatable independently of one another about the corresponding rotational axes. In other words, the rotatability of the one component is independent of the rotatability or the rotational position of the respective other component. For the same reason, the linear displaceability of the arm support is preferably also independent of the rotatability or the rotational position of the arm support or the arm support carrier.

In order to ensure a high degree of operating safety, in spite of the particularly large number of possible positions of the arm support, according to a second basic concept of the invention, in a preferred embodiment of the invention, limiting devices are provided for limiting the rotational range of the arm support and/or the rotational range of the arm support carrier. These limiting devices are constructed in such a way that rotational and/or linear movements of the components, which result in an undesirable, unsafe or uncomfortable position of the arm support, are not able to be adjusted.

In combination with the second basic concept of the invention, an embodiment of the invention has proved to be particularly advantageous in which it is possible for the user of the chair to adjust different functional states of the armrest selectively by using a switching mechanism. The switching mechanism is thus configured for switching between at least two functional states of the arm support and/or of the arm support carrier, wherein each functional state permits and/or predetermines a specific rotational range and/or a specific number of rotational positions of the arm support and/or of the arm support carrier. It is particularly advantageous, in other words, when the limiting devices for limiting the rotational range of the arm support and/or the rotational range of the arm support carrier are combined with a switching mechanism, wherein this switching mechanism preferably serves for selecting different rotational ranges from one another and/or for switching between these rotational ranges. In this manner, the rotational functionality of the arm support may be adjusted in a manner which is very user-friendly and specific to the user.

In the present case, in particular, it is provided to assign a plurality of functional states to the arm support carrier, while the rotational range of the arm support and thus the rotatability thereof is not determinable by specific functional states but instead is always intended to be freely unlimited. However, instead of the rotatability of the arm support carrier it is also possible to determine, in particular to limit, more accurately the rotatability of the arm support by defining the functional states. It is also possible to provide this in both components, i.e. both in the arm support carrier and in the arm support. The mechanism and device described herein in connection with the rotatability of the arm support carrier about the first rotational axis may accordingly also be used in connection with the rotatability of the arm support about the second rotational axis.

According to a further embodiment of the invention, an actuating element, in particular in the form of a push button which is preferably manually actuatable, is provided for actuating the switching mechanism. It has proved particularly advantageous in this case if the actuating element is disposed on or in the arm support carrier in such a way that it is not actuatable in all positions of the arm support carrier and/or the arm support, in particular if the actuating element is only accessible and actuatable when the arm support carrier and/or the arm support have a specific rotational position and/or when the arm support has a specific displaced position. In this manner, it is possible to avoid inadvertently actuating the actuating element and thus inadvertently switching the functional state. In one embodiment of the invention, an inadvertent actuation of the actuating element is prevented by the actuating element only being accessible when the arm support is in a displaced position, which is displaced to a maximum extent.

It has been shown that for handling the armrest during the adjustment of the arm support, it is particularly advantageous if in a first functional state the arm support carrier is rotatable within a defined rotational range relative to the armrest column, while in a second functional state the arm support carrier is secured in a defined rotational position relative to the armrest column.

Preferably, in this case the defined rotational range in the first functional state is at most 90°. If the rotational range of the arm support carrier is limitable, therefore, measures may be implemented which improve the usability of the armrest. Thus, for example, the rotatability may be limited for safety reasons, for example in order to avoid a rotation of the arm support too far inwardly, i.e. in the direction of the body of the chair user and/or to limit a rotation of the arm support too far outwardly, i.e. away from the body of the chair user, for example when standing up.

The defined rotational position of the arm support carrier in the second functional state is preferably a single rotational position, i.e. the arm support carrier may not be rotated in the second functional state, for example in order to limit the number of adjustable arm support positions for safety reasons. Leaving the rotational range of the first functional state and blocking the rotation of the arm support carrier in the second functional state is, for example, advantageous if the arm support is intended to be brought into an accurately defined initial position, for example in order to create a desired parallelism of the arm supports which are attached to both sides of the office chair. Preferably, in this case the defined rotational position in which the arm support carrier is secured in the second functional state to the armrest column is outside the defined rotational range of the first functional state.

Due to the possibility of selecting different rotational ranges, in particular by switching between two functional states, wherein by suitable structural measures, in principle, a defined rotational range of the arm support carrier between 0° and 360° may be assigned to each functional state, the individual positionability of the arm support carrier relative to the fixed armrest column may be predetermined. Combined with the rotatability of the arm support relative to the arm support carrier by 360° and the linear displaceability of the arm support, relative to the arm support carrier, in principle any position of the arm support relative to the armrest column may be adjusted or specific positions of the arm support may be excluded therefrom.

Other features which are considered as characteristic for the invention are set forth in the appended claims.

Although the invention is illustrated and described herein as embodied in an armrest, in particular for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
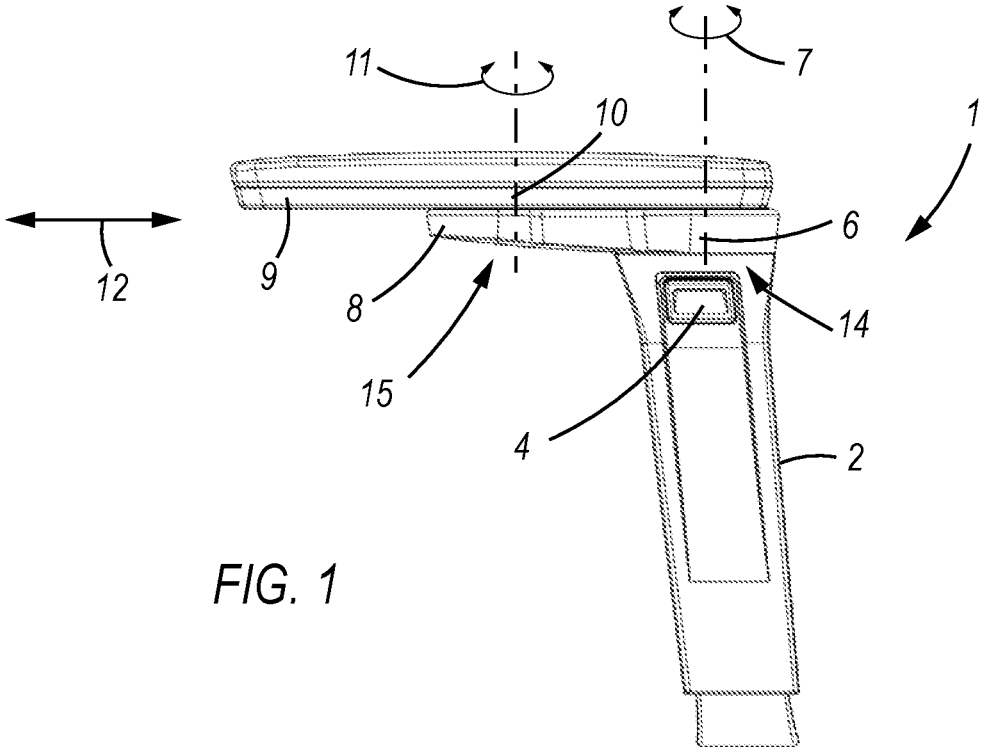
FIG. 1 is a diagrammatic, left-side elevational view of the armrest.
Figure 2:
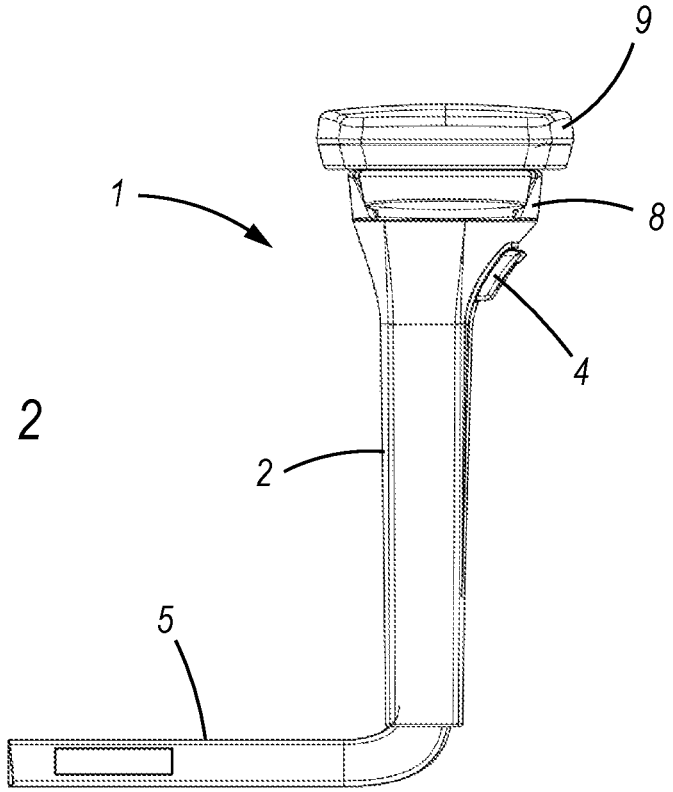
FIG. 2 is a front-elevational view of the armrest.
Figure 3:
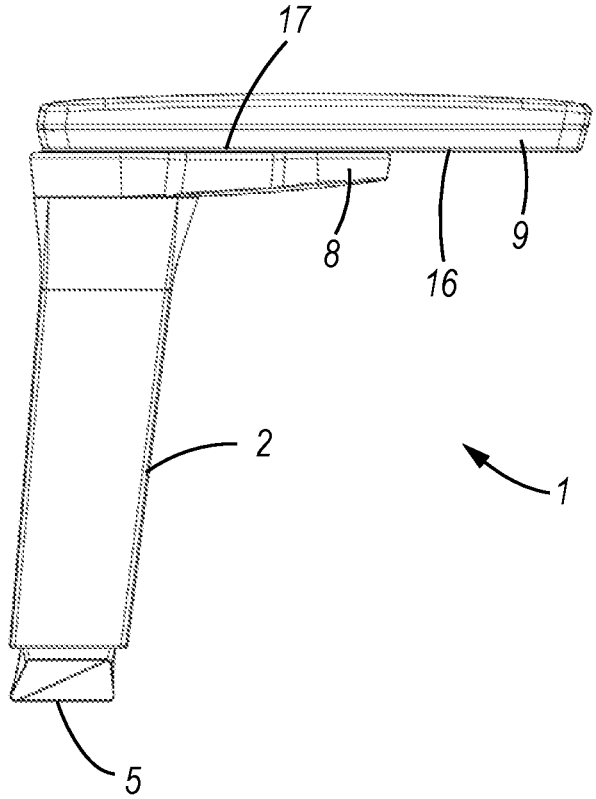
FIG. 3 is a right-side elevational view of the armrest.
Figure 4:
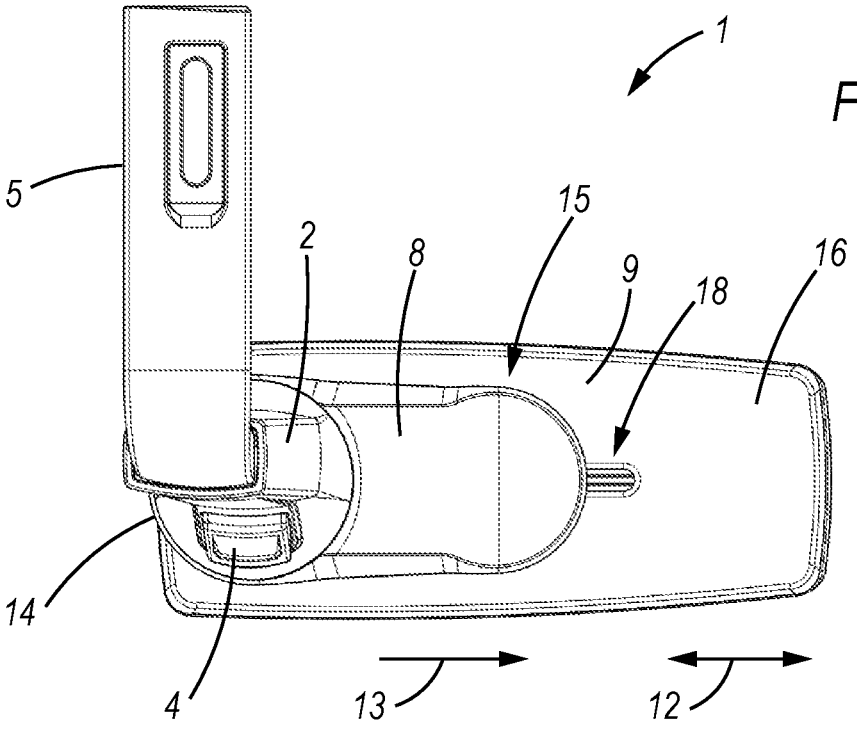
FIG. 4 is a bottom-perspective view of the armrest.
Figure 5:
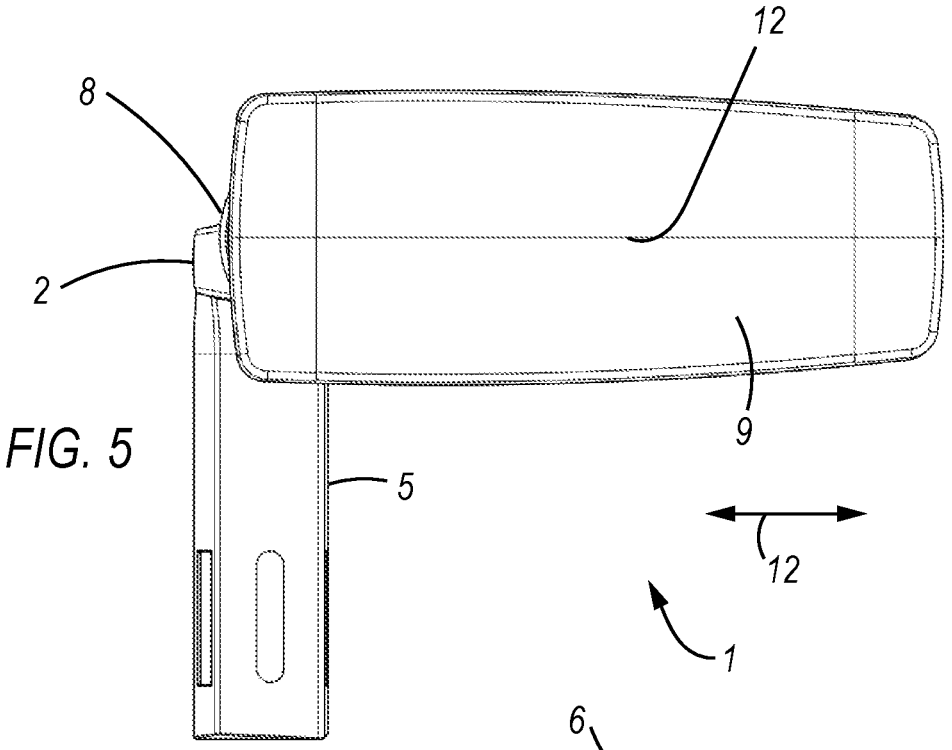
FIG. 5 is a top-plan view of the armrest.

Referring now in detail to the figures of the drawings, which are diagrammatic, not to scale, only contain important components and use the same reference numerals for elements having the same or comparable functions, and first, particularly, to FIGS. 1-5 thereof, there is seen an armrest 1 which includes a height-adjustable armrest column 2, in particular having a telescopable construction, which terminates at its upper end with a bearing head 3. An actuating lever 4 is provided for the height adjustment of the armrest 1. The actuating lever protrudes through a through-passage of the armrest column 2 which is open toward the outside. The armrest column 2 is fastenable to a (not illustrated) subframe of the office chair by using an armrest carrier 5 leading horizontally out of the lower bottom end thereof.

The armrest 1 includes an arm support carrier 8 which is disposed on the bearing head 3 of the armrest column 2 and which is rotatable about a first vertical rotational axis 6 in a first rotational direction 7. Moreover, the armrest 1 includes an arm support 9 which is mounted on the arm support carrier 8 and which is rotatable about a second vertical rotational axis 10 in a second rotational direction 11 by 360° and is displaceable in a linear manner relative to the arm support carrier 8 in a direction of displacement 12 in the arm support longitudinal direction 13.

The armrest column 2 thus carries the arm support carrier 8, while the arm support carrier 8 in turn carries the arm support 9. In this case the first ("rear") rotational axis 6 connects a rear region 14 of the arm support carrier 8 to the armrest column 2 and the second ("front") rotational axis 10 connects the arm support 9 to a front region 15 of the arm support carrier 8.

Suitable connecting devices which cooperate with one another are provided for the linear displacement on a lower face 16 of the arm support 9 and on an upper face 17 of the arm support carrier 8. More specifically, the linear displacement of the arm support 9 takes place along a groove 18 provided on the lower face 16 of the arm support 9 and extending in the arm support longitudinal direction 13. The groove 18 forms a linear sliding guide with suitable (not illustrated) connecting elements of the arm support carrier 8 engaging in the groove 18. These connecting elements are preferably structural elements disposed directly above the second rotational axis 10. The displacement movement preferably takes place by using a latching mechanism which is actuatable without a release button, wherein for example suitable (not illustrated) latching recesses are provided in the groove 18. The latching recesses cooperate with a (not illustrated) latching element of the arm support carrier 8.

The two rotational axes 6, 10 are not pivoted relative to one another and/or counter to one another and are not disposed coaxially to one another. Instead, the two rotational axes are located parallel to one another and spaced apart horizontally, and thus are not only positioned vertically but also offset horizontally from one another. Since they extend vertically, the rotations of the arm support carrier 8 and the arm support 9 take place in horizontal planes.

In a normal position, see FIGS. 1 to 5, the arm support 9 is located above the arm support carrier 8 in such a way that central longitudinal axes 21, 22 of these components overlap one another.

In this case it is assumed that the central longitudinal axis 21 of the arm support 9 is predetermined by the elongated shape of the arm support 9, while the path of the central longitudinal axis 22 of the arm support carrier 8 is determined by the position of the two rotational axes 6, 10, with the central longitudinal axis 22 extending therethrough.

In a first functional state, a rotational range 23 of the arm support carrier 8 is limited in the case shown herein, for example, by 60° inwardly and 30° outwardly, so that the arm support carrier 8 is rotatable within a defined rotational range of plus 60°/minus 30° starting from the normal position relative to the armrest column 2. In other words, the arm support carrier 8 may be pivoted up to 60° outwardly and up to 30° inwardly. The pivotability within this rotational range is preferably implemented without a release button. In other words, a release button or the like is not required for pivoting the arm support carrier 8 within this rotational range 23. Preferably, the adjustment in this case takes place in a latched manner, i.e. cooperating latching elements are provided both on the armrest column 2 and on the arm support carrier 8, the latching elements forming a latching mechanism which is actuatable without a release button. In order to implement the latched rotational movement, preferably latching recesses 24 which cooperate with a (not illustrated) latching element are provided, wherein without the actuation of a release button or the like the latching element is able to be moved, counter to the resistance and by deformation, from one latching recess to the next. Preferably, the latching recesses 24 are provided on both sides with identical lead-in chamfers, so that both the forward and rearward movement may be overcome with the same expenditure of force. Moreover, the 360° rotation of the arm support 9 about the second rotational axis 10 preferably takes place by adopting defined latching positions, to which end cooperating latching elements including latching recesses 25 are provided at a suitable point on the arm support carrier 8 and on the arm support 9, the latching elements forming a latching mechanism which is actuatable without a release button.

If such a "free" movement within the predetermined rotational range 23 of the first functional state is not desired, but instead the rotation of the arm support carrier 8 is intended to be fully blocked, a change of functional state is provided according to the invention. To this end, the arm support carrier 8 leaves the first rotational range 23 and is rotated into a blocked position 26 in which the arm support carrier 8 is secured relative to the armrest column 2 so that a rotation of the arm support carrier 8 about the first rotational axis 6 is no longer possible. In this second functional state, the arm support carrier 8 is secured to the armrest column 2 in a single defined rotational position 26 outside the defined rotational range 23 of the first functional state. The rotatability of the arm support carrier 8 is blocked thereby.

The rotatability of the arm support 9 by 360° about the second rotational axis 10 and the linear displaceability of the arm support 9 along the groove 18, however, remains unaltered irrespective of the respective functional state of the arm support carrier 8.

A switching mechanism is provided for switching between these two functional states of the arm support carrier 8. In order to actuate the switching mechanism, a manually actuatable actuating element in the form of a push button 27 is provided. Due to the actuation thereof a rotational angle limiter is moved out of its locked position and thus the rotational angle limitation is removed.

Figure 6:
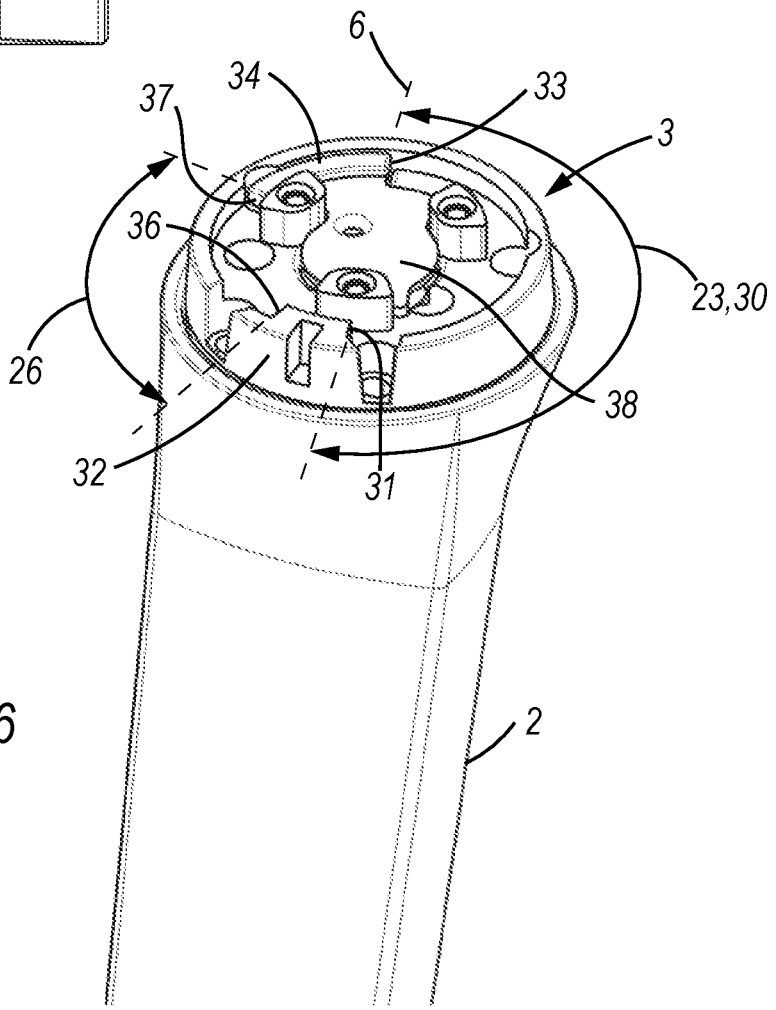
FIG. 6 is a fragmentary, perspective view of a bearing head of an armrest column.
Figure 7:
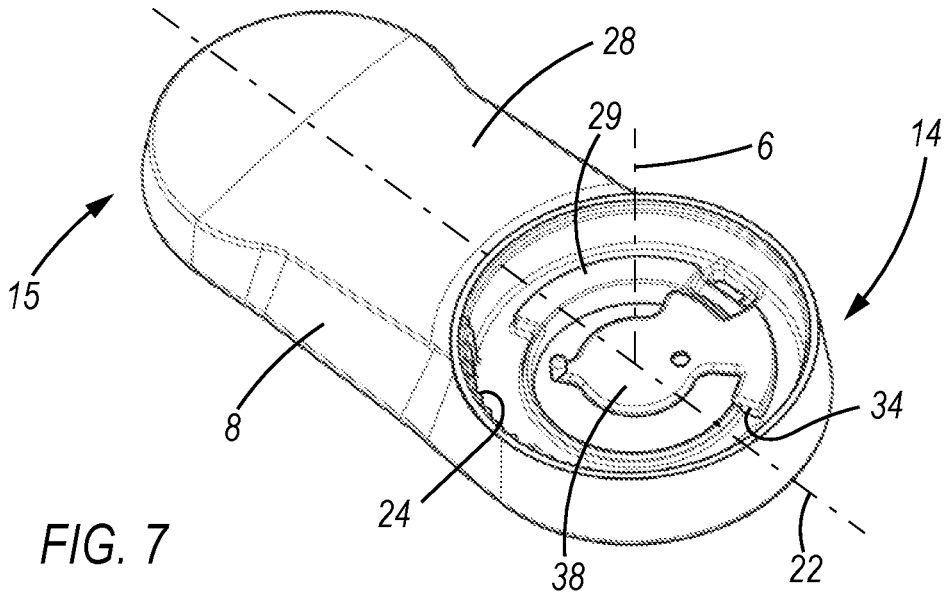
FIG. 7 is a bottom-perspective view of an arm support carrier.
Figure 8:
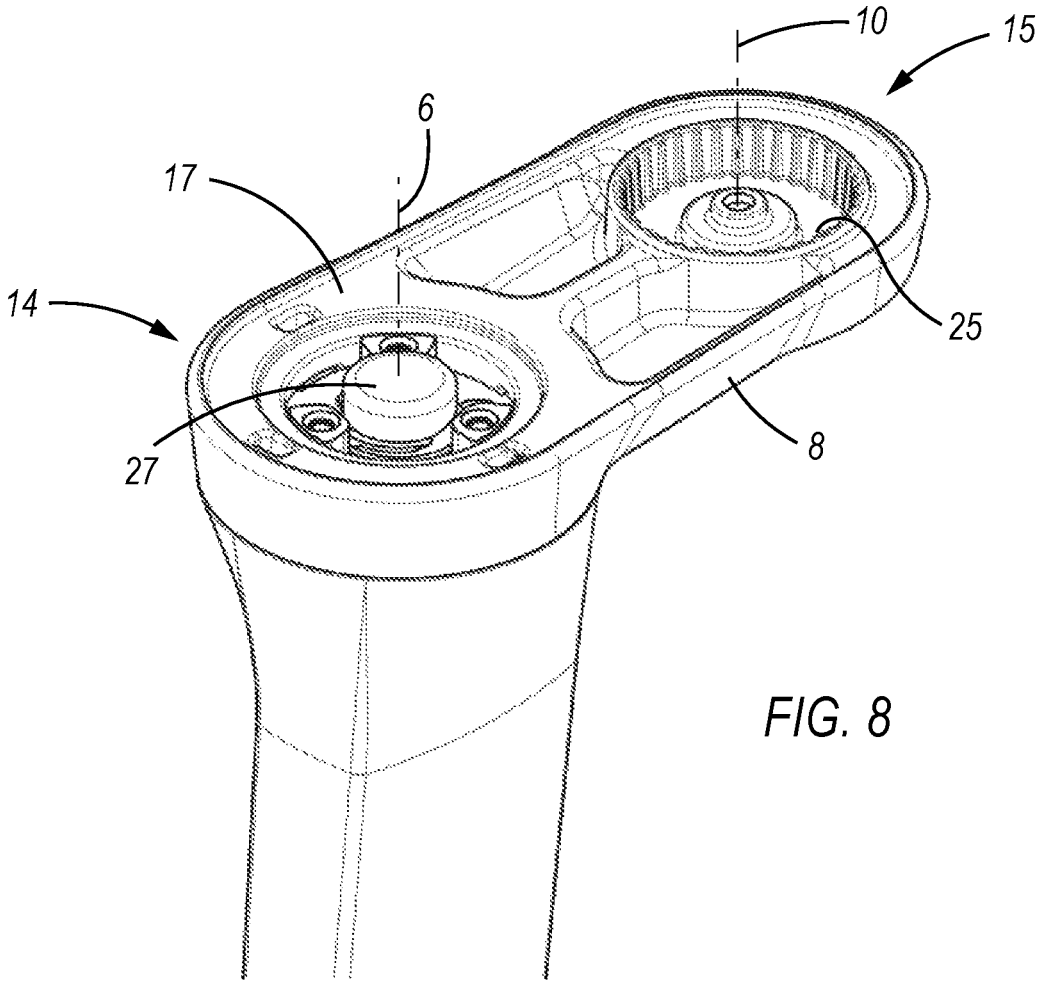
FIG. 8 is a fragmentary, perspective view of the arm support carrier disposed on the bearing head.
Figure 9:
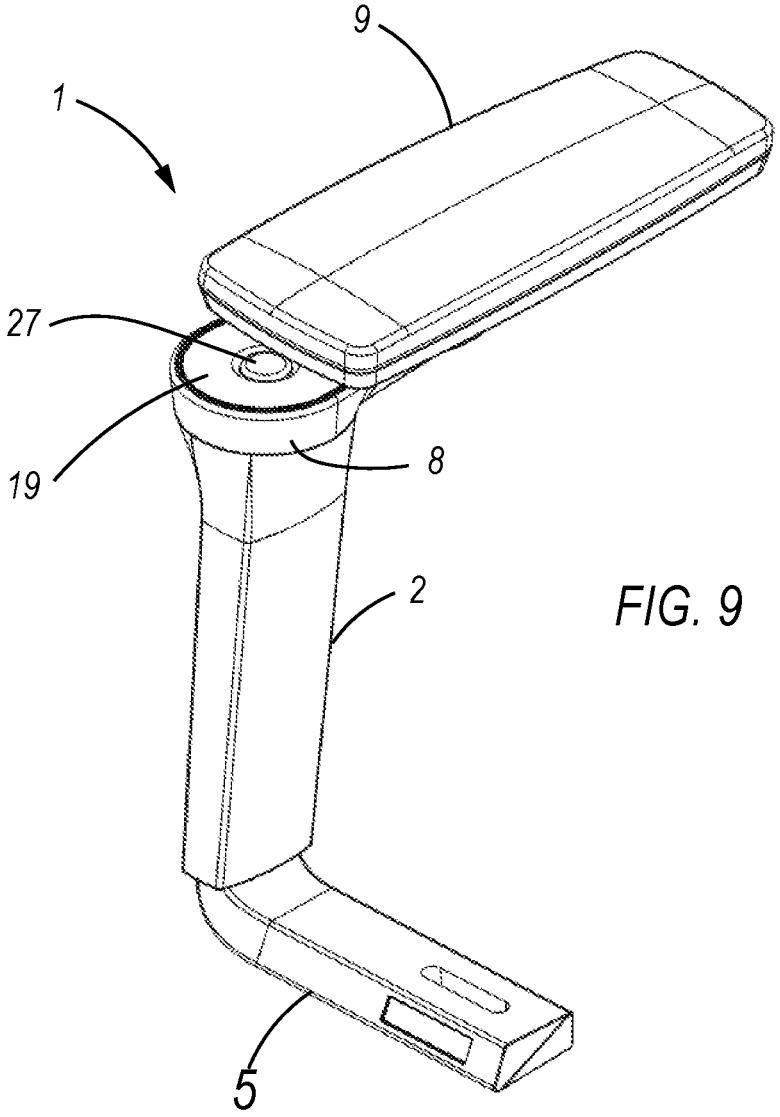
FIG. 9 is a perspective view of the armrest fully mounted with an arm support.
Figure 17:
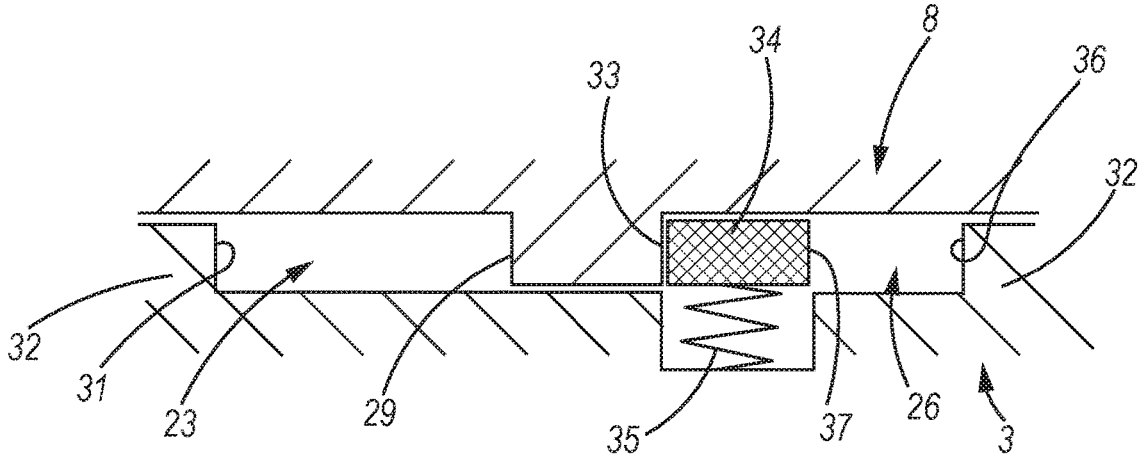
FIG. 17 shows a switching mechanism developed on one plane (in a 1st functional state)

Structurally, this is achieved for example in such a way that a limiter block 29, which is disposed on the lower face 28 of the arm support carrier 8 and which is connected fixedly in terms of rotation to the arm support carrier 8, is moved with a rotation of the arm support carrier 8 about the first rotational axis 6 on a circular path, a central point thereof being determined by the first rotational axis 6, as is seen in FIGS. 7 and 17. In this case, the limiter block 29, at one end of its movement path 30, strikes against a first stop 31 of an end stop 32 which is provided in the bearing head 3 of the armrest column 2 and which is fixedly connected to the bearing head 3, while at the other end of its movement path 30 the limiter block strikes against a first stop surface 33 of a locking element 34, namely the rotational angle limiter of the switching mechanism, as is seen in FIG. 6. The configuration of the end stop 32, on one hand, and the locking element 34, on the other hand, on the circular movement path 30, thus defines the rotational range 23 of the limiter block 29 and thus of the arm support carrier 8.

Figure 18:
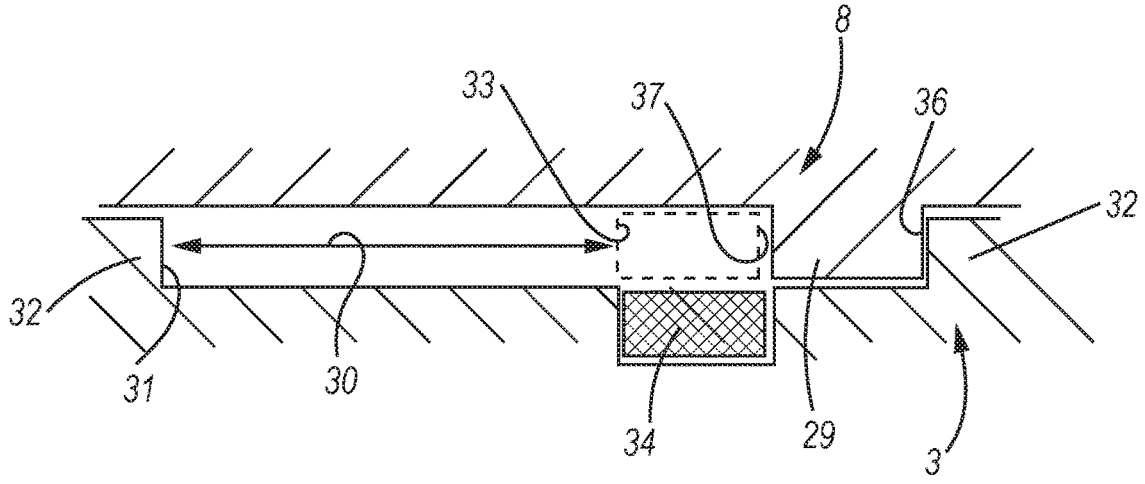
FIG. 18 shows the switching mechanism developed on one plane (in a 2nd functional state).

The locking element 34, which is shown both in FIG. 6 and in FIG. 7 in order to illustrate the cooperation of the arm support carrier 8 and the bearing head 3, is movable counter to the spring force of a spring element 35 by actuating the push button 27 (not illustrated in FIGS. 17 and 18) from its locked position downwardly into the bearing head 3 of the armrest column 2, seen in FIG. 18, whereby the locking element 34 is moved out of the movement path 30 of the limiter block 29. To this end, the locking element 34 is provided with a pressure plate 38 which in the mounted state is located below the push button 27 and is able to be acted upon thereby. The limiter block 29 may then be rotated into a position on the other side of the locking element 34, with a rotation of the arm support carrier 8, into a second rotational range 26. In the present case, this second rotational range 26 is configured in such a way that after the release of the push button 27 and the spring-assisted return of the locking element 34 into the locked position, the limiter block 29 is located between the second stop 36 of the end stop 32, on one hand, and the second stop surface 37 of the locking element 34, on the other hand, in such a way that a rotation of the arm support carrier 8 about the first rotational axis 6 is no longer possible. The arm support carrier 8 in this state is blocked, as is seen in FIG. 18.

The limiter block 29 of the arm support carrier 8 and/or the end stop 32 of the bearing head 2 and the locking element 34, which is movable by the push button 27, thus serve as limiting devices within the meaning of the invention, for limiting the rotational range of the arm support carrier 8.

Due to a suitable dimensioning of the limiter block 29, on one hand, and/or the end stop 32 and the locking element 34, on the other hand, other functional states may also be implemented. Thus, for example, it is possible to define in addition to a blocked position (or even without such a blocked position) two differently sized rotational ranges so that the user may determine whether, for example, a larger or smaller pivotability of the arm support carrier 8 is desired.

The actuating element in the form of the push button 27 is disposed on the upper face 17 of the arm support carrier 8 in the region of the first rotational axis 6. The upper face 17 is provided with a cover 19, so that the actuating element is only accessible and actuatable when the arm support carrier 8 and/or the arm support 9 have a specific rotational position and/or when the arm support 9 has a specific displaced position.

In order to adjust the position of the arm support 9, the arm support 9 merely has to be gripped and correspondingly rotated through the two rotational axes 6, 10, provided this is permitted by the adjustments to the rotatability of these axes, and optionally displaced in a linear manner. Since no release buttons are required at least within a functional state of the arm support carrier 8, the adjustment of the desired arm support positions may be implemented with minimal effort in terms of technical control. The change from one functional state of the arm support carrier 8 to a different functional state is possible by simply actuating the push button 27 and rotating the arm support carrier 8 into the respectively desired functional position.

Figure 10:
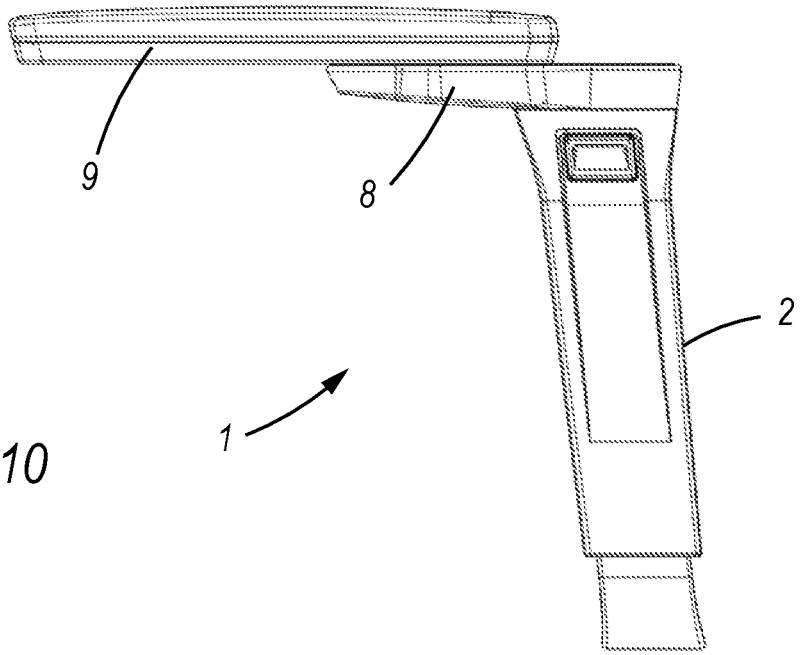
FIGS. 10 and 11 are left-side elevational views of the armrest as in FIG. 3 but with the arm supports positioned at different distances toward the front and rear.
Figure 11:
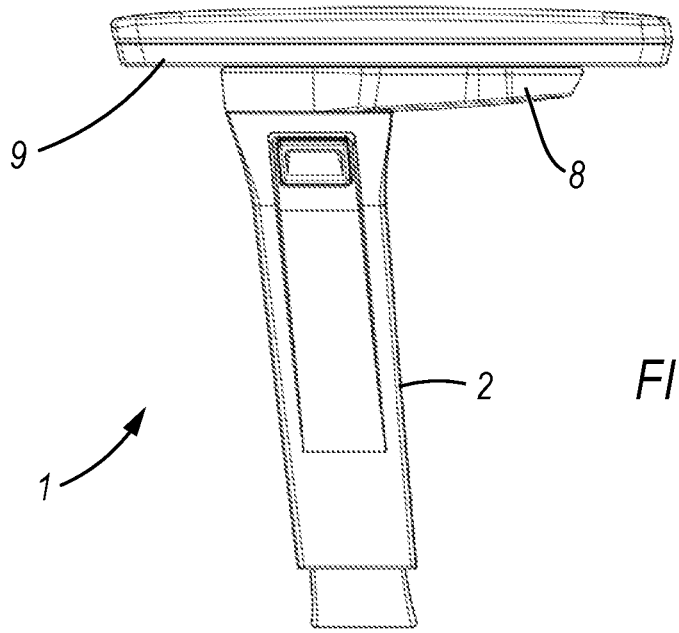
Figure 12:
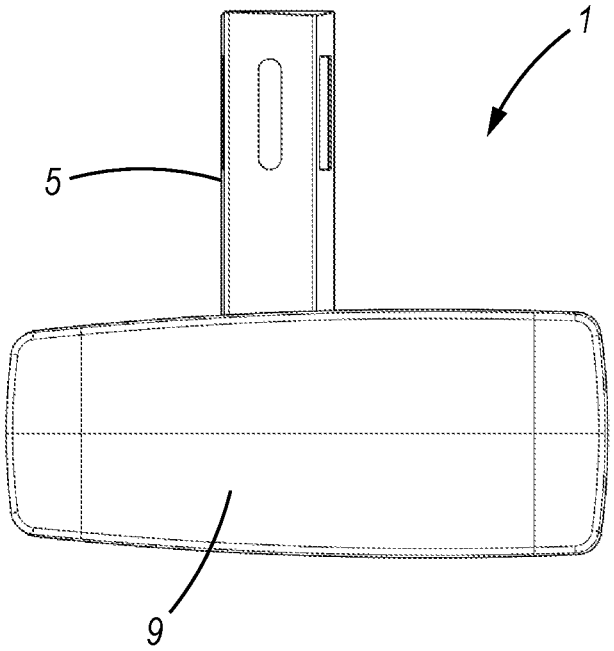
FIGS. 12 to 16 are top-plan views of the armrest as in FIG. 5, but with the arm supports and/or arm support carriers positioned at different distances toward the front and rear and partially rotated.
Figure 13:
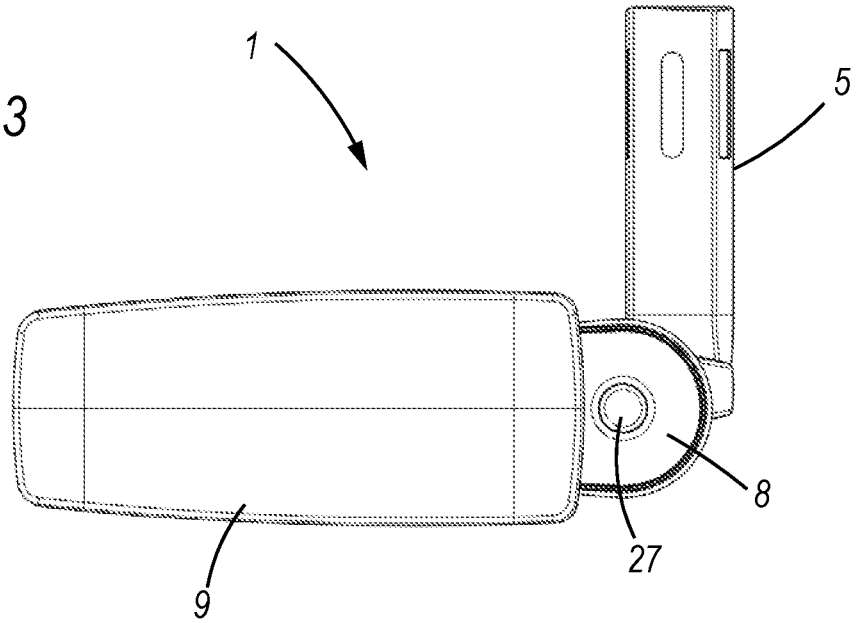
Figure 14:
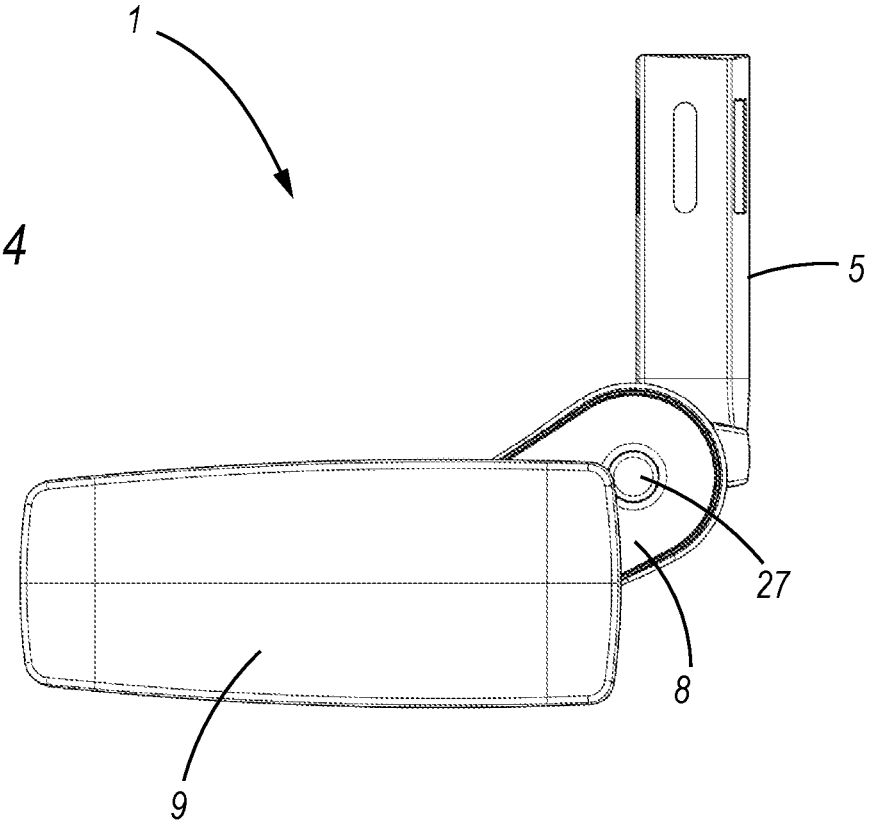
Figure 15:
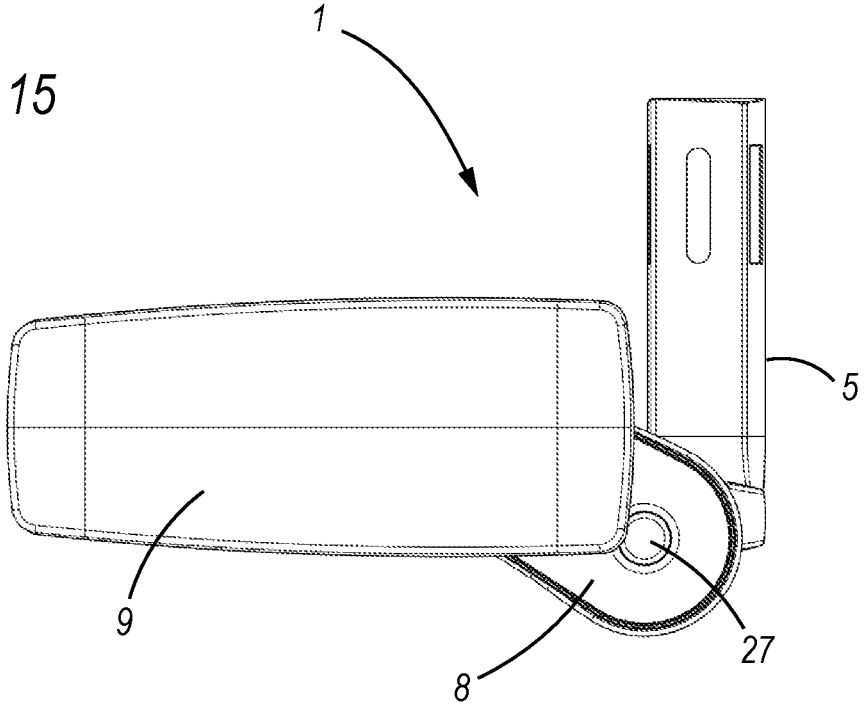
Figure 16:
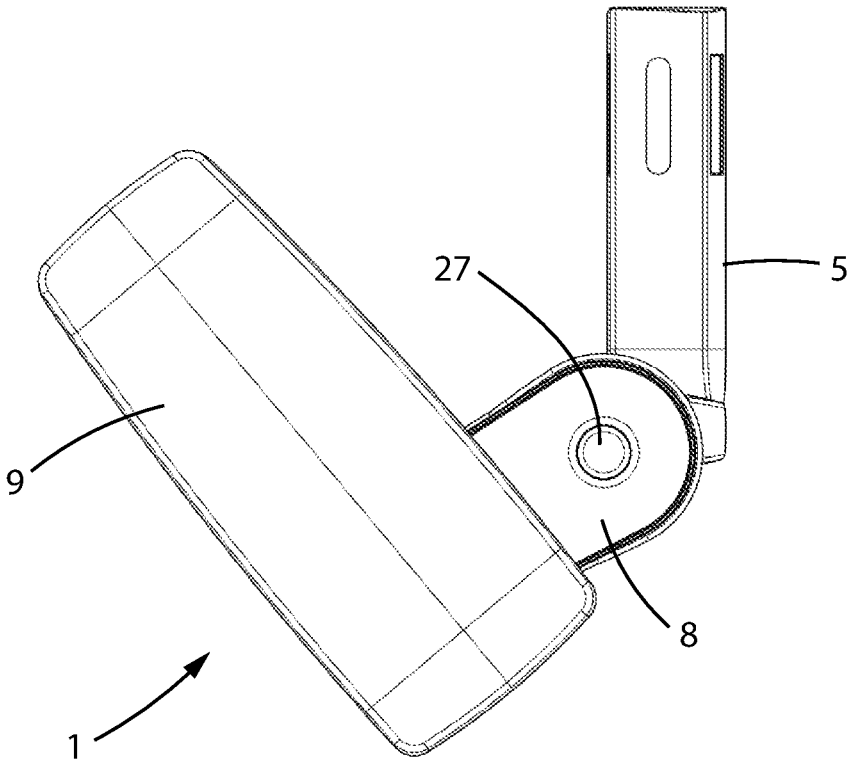

Thus, for example, the arm support 9 may not only be borne by an arm support carrier 8 facing in the longitudinal direction of the chair to the front, as seen in FIG. 1 (central position) and FIG. 10 (extreme forward position), but also an extreme rear position of the arm support 9 is possible when the arm support carrier 8 is rotated by 180°, as is seen in FIG. 11 (not possible with the above-described rotational angle limitation of the arm support carrier 8 by 90°). The arm support 9 may be rotated in any manner by 360° in every position, thus also in the front position shown in FIG. 5 and in the central position shown in FIG. 12. In other words, the wider end of the arm support 9 facing to the rear in the longitudinal direction of the chair in FIG. 12 may also face to the front. In a displaced position of the arm support 9 moved comparably far forward, as shown in FIG. 13, the push button 27 on the upper face 17 of the arm support carrier is accessible and may be actuated. The position of the arm support 9, facing strictly in the longitudinal direction of the chair and not deviating from the normal position, may also be maintained when the arm support carrier 8 is pivoted inwardly, as is seen in FIG. 14, or when the arm support carrier 8 is pivoted outwardly, as is seen in FIG. 15. The arm supports 9 attached to both sides of the seat are then located closer together or further apart. An unusual position of the arm support 9, pivoted inwardly to a great extent, with the outwardly rotated arm support carrier 8, is illustrated in FIG. 16 in order to show the many different possibilities of adjusting the armrest 1 according to the invention.

All of the features discussed in the description, the following claims and the drawings may be important to the invention both individually and in any combination with one another.

The following is a summary list of reference numerals and the corresponding structure used in the above description of the invention:

1 Armrest
2 Armrest column
3 Bearing head
4 Actuating lever
5 Armrest carrier
6 First rotational axis
7 First rotational direction
8 Arm support carrier
9 Arm support
10 Second rotational axis
11 Second rotational direction
12 Direction of displacement
13 Arm support longitudinal direction
14 Rear region of arm support carrier
15 Front region of arm support carrier
16 Lower face of arm support
17 Upper face of arm support carrier
18 Groove
19 Cover
20 (not used)
21 Central longitudinal axis of arm support
22 Central longitudinal axis of arm support carrier
23 First rotational range
24 Latching recesses (rear rotational axis)
25 Latching recesses (front rotational axis)
26 Second rotational range (blocked position)
27 Push button, actuating element
28 Lower face of arm support carrier
29 Limiter block
30 Movement path of limiter block
31 First stop
32 End stop element
33 First stop surface
34 Locking element
35 Spring element
36 Second stop
37 Second stop surface
38 Pressure plate

The invention claimed is:

1. An armrest for a chair, the armrest comprising:

an armrest column including an arm support carrier, said arm support carrier being mounted on said armrest column and being rotatable about a first rotational axis;

an arm support being mounted on said arm support carrier, said arm support being rotatable about a second rotational axis and said arm support being displaceable linearly relative to said arm support carrier;

said first and second rotational axes being spaced apart from one another; and a switching mechanism for switching between at least two functional states of at least one of said arm support or said arm support carrier.

2. The armrest according to claim 1, wherein said first and second rotational axes are not coaxial.

3. The armrest according to claim 1, wherein said first and second rotational axes are parallel to one another.

4. The armrest according to claim 1, wherein said first and second rotational axes are vertical.

5. The armrest according to claim 1, wherein said first and second rotational axes are spaced apart horizontally from one another.

6. The armrest according to claim 1, wherein:

said arm support carrier includes a first region and a second region being spaced apart from each other;

said first rotational axis interlinks said first region and said armrest column; and said second rotational axis interlinks said arm support and said second region.

7. The armrest according to claim 1, which further comprises limiting devices for at least one of limiting a rotational range of said arm support or limiting a rotational range of said arm support carrier.

8. The armrest according to claim 1, wherein each of said functional states provides a specific rotational range of at least one of said arm support or said arm support carrier.

9. The armrest according to claim 1, wherein each of said functional states provides a specific number of rotational positions of at least one of said arm support or said arm support carrier.

10. The armrest according to claim 1, which further comprises an actuating element for actuating said switching mechanism.

11. The armrest according to claim 10, wherein said actuating element is a push button.

12. The armrest according to claim 10, wherein said actuating element is disposed on or in said arm support carrier, and said actuating element is not actuatable in all positions of at least one of said arm support carrier or said arm support.

13. The armrest according to claim 12, wherein said actuating element is only actuatable when at least one of said arm support carrier or said arm support have a specific rotational position.

14. The armrest according to claim 12, wherein said actuating element is only actuatable when said arm support has a specific displaced position.

15. The armrest according to claim 1, wherein said at least two functional states include a first functional state in which said arm support carrier is rotatable within a defined rotational range relative to said armrest column and a second functional state in which said arm support carrier is secured in a defined rotational position relative to said armrest column.

16. The armrest according to claim 15, wherein said defined rotational position in which said arm support carrier is secured relative to said armrest column in said second functional state is outside said defined rotational range of said first functional state.

17. The armrest according to claim 1, wherein the chair is an office chair.

18. The armrest according to claim 1, wherein said armrest column is height adjustable.

* * * * *